US005427075A

United States Patent [19]

Yamanaka et al.

[11] Patent Number: 5,427,075

[45] Date of Patent: Jun. 27, 1995

[54] EVAPORATIVE EMISSION CONTROL SYSTEM FOR INTERNAL COMBUSTION ENGINES

[75] Inventors: Masayoshi Yamanaka; Kazutomo Sawamura; Hiroshi Maruyama; Yasunari Seki, all of Wako, Japan

[73] Assignee: Honda Giken Kogyo Kabushiki Kaisha, Tokyo, Japan

[21] Appl. No.: 216,970

[22] Filed: Mar. 24, 1994

[30] Foreign Application Priority Data

Jun. 28, 1993 [JP] Japan ..... 5-181946

[51] Int. Cl.[6] ..... F02M 33/02; F02M 25/08

[52] U.S. Cl. ..... 123/520; 123/198 D

[58] Field of Search ..... 123/518, 519, 520, 198 D

[56] References Cited

U.S. PATENT DOCUMENTS

| | | | |
|---|---|---|---|
| 4,949,695 | 8/1990 | Uranishi et al. | 123/520 |
| 5,143,035 | 9/1992 | Kayanuma | 123/520 |
| 5,174,265 | 12/1992 | Sekine | 123/520 |
| 5,191,870 | 3/1993 | Cook | 123/520 |
| 5,197,442 | 3/1993 | Blumenstock et al. | 123/520 |
| 5,259,353 | 11/1993 | Nakai et al. | 123/520 |
| 5,261,379 | 11/1993 | Lipinski et al. | 123/520 |
| 5,267,470 | 12/1993 | Cook | 123/520 |
| 5,297,529 | 3/1994 | Cook et al. | 123/520 |
| 5,315,980 | 5/1994 | Otsuka et al. | 123/520 |
| 5,317,909 | 6/1994 | Yamada et al. | 123/520 |
| 5,333,589 | 8/1994 | Otsuka | 123/520 |

FOREIGN PATENT DOCUMENTS

| | | |
|---|---|---|
| 2-102360 | 4/1990 | Japan . |
| 4-362264 | 12/1992 | Japan . |
| WO91/12426 | 8/1991 | WIPO . |

*Primary Examiner*—Henry C. Yuen
*Assistant Examiner*—Thomas N. Moulis
*Attorney, Agent, or Firm*—Nikaido, Marmelstein Murray & Oram

[57] ABSTRACT

An evaporative emission control system includes a valve arranged in a passage communicating between a fuel tank and a canister. The valve opens the passage when pressure within part of the evaporative emission control system upstream of the valve exceeds a predetermined value and, closes the passage when the pressure is below the predetermined value. It is determined that the evaporative emission control system is normal when a value of the pressure with the part of the system detected by a pressure sensor is lower than a predetermined reference value below atmospheric pressure.

10 Claims, 8 Drawing Sheets

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for an internal combustion engine for purging evaporative fuel generated from a fuel tank into an intake passage of the engine, which is capable of detecting an abnormality thereof.

2. Prior Art

Conventionally, an evaporative emission control system for an internal combustion engine has been widely used, which comprises a fuel tank, a canister for adsorbing evaporative fuel generated from the fuel tank, a purge control valve arranged in a passage communicating between the canister and the intake passage of the engine for control of purging of evaporative fuel absorbed in the canister into the intake passage. Further, a method of detecting an abnormality in this type of evaporative emission control system has been proposed e.g. by Japanese Provisional Patent Publication (Kokai) No. 2-102360 (hereinafter referred to as "Publication 1"), Japanese Provisional Patent Publication (Kokai) No. 4-362264 (hereinafter referred to as "Publication 2"), and International Publication No. WO 91/12426 (hereinafter referred to as "Publication 3").

Publication 1 discloses a method of determining that the evaporative emission control system is abnormal (the passage communicating between the fuel tank and the canister is clogged up), when the tank internal pressure detected by pressure-detecting means arranged in a pressure-detecting conduit of the fuel tank is higher than a predetermined value.

Publication 2 discloses a method of negatively pressurizing the evaporative emission control system by the use of negative pressure created with the intake passage of the engine, then isolating the interior of the evaporative emission control system to detect a change of pressure within the system over a predetermined time period, and determining that the evaporative emission control system is abnormal (there is a leak of evaporative fuel) when the change of pressure within the system is larger than a predetermined value.

Publication 3 discloses a method of providing pressure-detecting means for detecting pressure within the system, and a control valve for opening and closing a passage for introducing the air into the canister, and closing the control valve while at the same time opening the purge control valve to determine that the system is normal if the system can be negatively pressurized.

However, the above methods suffer from the following problems:

(1) The method of Publication 1 cannot detect a leak of evaporative fuel, since it determines that the system is abnormal simply when the tank internal pressure is higher than the predetermined reference value.

(2) Although the methods of Publications 1 and 2 can detect a leak of evaporative fuel, it takes a fairly long time period to negatively pressurize the system to a predetermined level, and further, evaporative fuel is purged from the canister and the fuel tank into the intake passage of the engine during negative pressurization of the system for abnormality detection, which can make an air-fuel mixture supplied to the engine overrich over the long time period, causing degraded drivability and exhaust emission characteristics of the engine.

SUMMARY OF THE INVENTION

It is the object of the invention to provide an evaporative emission control system for an internal combustion engine which is capable of easily determining whether the system suffers from a leak of evaporative fuel, without unnecessarily performing the negative pressurization of the system to check for an abnormality thereof.

To achieve the above object, the present invention provides an evaporative emission control system for an internal combustion engine, including a fuel tank, a canister for adsorbing evaporative fuel generated from the fuel tank, a passage communicating between the fuel tank and the canister, valve means for opening the passage when pressure within part of the evaporative emission control system upstream of the valve means exceeds a predetermined value and closing the passage when the pressure within the part of the evaporative emission control system is below the predetermined value, and pressure-detecting means for detecting the pressure within the part of the evaporative emission control system.

The evaporative emission control system according to the invention is characterized by comprising:

diagnosis means for determining that the evaporative emission control system is normal when a value of the pressure within the part of the evaporative emission control system detected by the pressure-detecting means is lower than a predetermined reference value below atmospheric pressure.

Preferably, the diagnosis means causes the pressure-detecting means to detect the pressure within the part of the evaporative emission control system a plurality of times, and determines that the evaporative emission control system is normal when at least the minimum value of values of the pressure detected by the pressure-detecting means is lower than the predetermined reference value.

More preferably, the diagnosis means determines that the evaporative emission control system is abnormal, when the minimum value of the values of the pressure within the part of the evaporative emission control system detected by the pressure-detecting means is higher than the predetermined reference value, and at the same time an average value of the values of the pressure within the part of the evaporative emission control system detected by the pressure-detecting means is equal to the atmospheric pressure or a value in the vicinity thereof.

Preferably, the evaporative emission control system includes closing means for forcibly closing the passage, and the diagnosis means causes the closing means to close the passage when it is not determined that the evaporative emission control system is normal, and determines that the evaporative emission control system is abnormal when a rise in the pressure occurring thereafter within the part of the evaporative emission control system is below a predetermined value.

More preferably, the closing means is second valve means arranged in the passage.

Preferably, the engine includes an intake passage, and the evaporative emission control system includes an air passage communicating between the canister and the atmosphere, pressure-relieving valve for opening and closing the air passage, a purging passage communicating between the canister and the intake passage, a purge control valve arranged in the purging passage for opening and closing the purging passage, and negative pressure diagnosis means for determining abnormality of the evaporative emission control system, based on values of the pressure detected when the evaporative emission control system is set to a negatively-pressurized state by closing the pressure-relieving valve and opening the purge control valve, the negative pressure diagnosis means being operated when the diagnosis means has not determined that the evaporative emission control system is normal.

The above and other objects, features and advantages of the invention will be more apparent from the following detailed description taken in conjunction with the accompanying drawings.

DETAILED DESCRIPTION

The invention will be described in detail with reference to the drawings showing an embodiment thereof.

Figure 1:
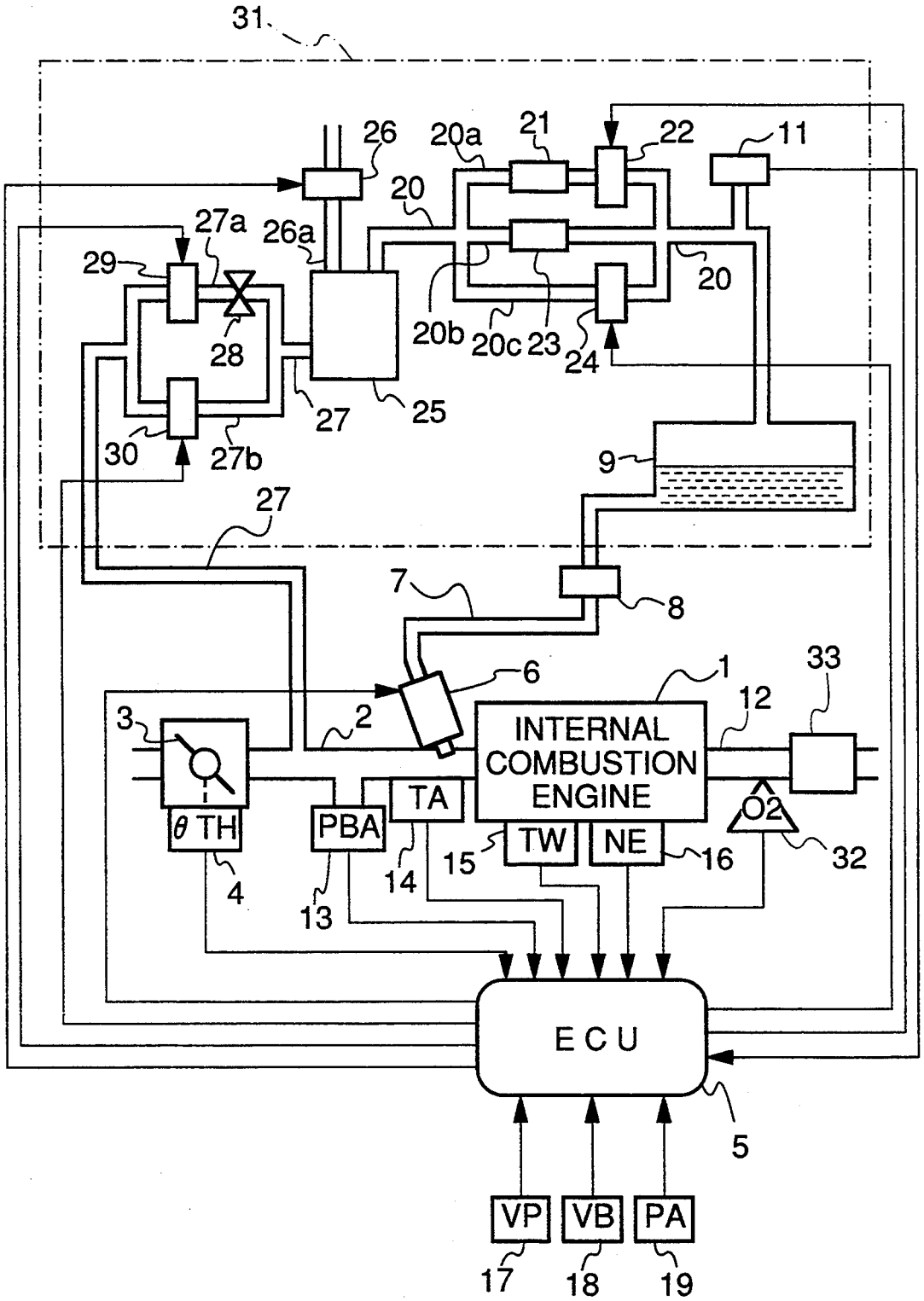
FIG. 1 is a block diagram showing the whole arrangement of an evaporative emission control system according to an embodiment of the invention.

FIG. 1 is a block diagram showing the whole arrangement of an evaporative emission control system for an internal combustion engine according to an embodiment of the invention.

In the figure, reference numeral 1 designates an internal combustion engine (hereinafter simply referred to as "the engine") having four cylinders, for instance. Arranged across an intake pipe 2 of the engine 1 is a throttle valve 3. A throttle valve opening ($\theta$TH) sensor 4 is connected to the throttle valve 3 for generating an electric signal indicative of the sensed throttle valve opening and supplying the same to an electronic control unit (hereinafter referred to as "the ECU") 5.

Fuel injection valves 6 are inserted into the interior of the intake pipe 2 at locations intermediate between the cylinder block of the engine 1 and the throttle valve 3 and slightly upstream of respective intake valves, not shown. Each of the fuel injection valves 6 is connected to a fuel tank 9 via a fuel supply pipe 7, across which a fuel pump 8 is provided. The fuel injection valves 6 are electrically connected to the ECU 5 to have their valve opening period controlled by signals therefrom.

Mounted downstream of the throttle valve 3 of the intake pipe 2 are an intake pipe absolute pressure (PBA) sensor 13 for detecting absolute pressure PBA within the intake pipe and an intake air temperature (TA) sensor 14 for detecting an intake air temperature TA. Signals indicative of the detected values thereof are supplied to the ECU 5.

An engine coolant temperature (TW) sensor 15 formed of a thermistor or the like is inserted into a coolant passage filled with a coolant and formed in the cylinder block of the engine 1, so that an electric signal indicative of the sensed engine coolant temperature TW is supplied to the ECU 5.

An engine rotational speed (NE) sensor 16 is arranged in facing relation to a camshaft or a crankshaft of the engine 1, neither of which is shown.

The NE sensor 16 generates a pulse as a TDC signal pulse at each of predetermined crank angles whenever the crankshaft rotates through 180 degrees, the pulse being supplied to the ECU 5.

Arranged in an intermediate portion of the exhaust pipe 12 is an $O_2$ sensor 32 as an exhaust gas ingredient concentration sensor for detecting concentration of oxygen in exhaust gases and supplying a signal indicative of voltage VO2 proportional to the detected value of concentration of oxygen to the ECU 5. A three-way catalyst 33 as an exhaust gas-purifying device is arranged at a location downstream of the $O_2$ sensor 32.

Connected to the ECU 5 are a vehicle speed sensor 17 for detecting the traveling speed VP of a vehicle having the engine 1 installed thereon, a battery voltage sensor 18 for detecting battery voltage VB, and an atmospheric pressure sensor 19 for detecting atmospheric pressure PA, the signals indicative of the detected values being supplied to the ECU 5.

Next, an evaporative emission control system (hereinafter referred to as "the emission control system") will be described, which includes a fuel tank 9, a charging passage 20, a canister 25, a purging passage 27, etc.

The fuel tank 9 is connected to the canister 25 via the charging passage 20 which has first to third branches **20*a* to 20*c*. A tank internal pressure sensor 11 is arranged in the charging passage 20 connecting the branches 20*a* to 20*c* with the fuel tank 9 for detecting tank internal pressure PT, as a differential pressure between the tank internal pressure PT and atmospheric pressure (which therefore can assume a negative or positive value), and supplying a signal indicative of the detected tank internal pressure to the ECU 5. Inserted into the first branch 20*a* are a one-way valve 21 and a puff loss valve 22. The one-way valve 21 is constructed so as to open when the tank internal pressure PT is about 5 mmHg higher than the atmospheric pressure. The puff loss valve 22 is an electromagnetic valve which is kept open during purging, as described hereinbelow, and is kept closed while the engine is stopped, the operation thereof being controlled by the ECU 5**.

Inserted into the second branch **20*b* is a two-way valve 23, which is constructed so as to open when the tank internal pressure PT is about 20 mmHg higher than the atmospheric pressure and when the tank internal pressure PT is lower, by 10 mmHg, than pressure acting on a canister 25 side of the two-way valve 23**.

Inserted into the third branch **20*c* is a bypass valve 24, which is formed by an electromagnetic valve of normally-closed type, while it is opened and closed during the execution of the negative pressure check, as described hereinbelow, the operation thereof being controlled by the ECU 5**.

The canister 25 accommodates active carbon for adsorbing evaporative fuel generated from the fuel tank, and is provided with an intake port, not shown, to communicate with the atmosphere via a passage 26a. Inserted into the passage 26a is a drain shut valve 26, which is formed by a normally-open electromagnetic valve, and it is temporarily closed during execution of abnormality determination, described hereinbelow, the operation thereof being controlled by the ECU 5.

The canister 25 is connected to a portion of the intake pipe 2 downstream of the throttle valve 3 via the purging passage 27, which has first and second branches 27a and 27b. Inserted into the first branch 27a are a jet orifice (restriction) 28 and a jet purge control valve 29, and into the second branch 27b a purge control valve 30, respectively. The jet purge control valve 29 is formed by an electromagnetic valve and controls an amount of a mixture of air and evaporative fuel to be purged, at such a small flow rate as cannot be precisely controlled by means of the purge control valve 30, and the purge control valve 30 is formed by an electromagnetic valve and continuously controls the flow rate of the mixture in response to a change in the on-off duty ratio of a control signal supplied thereto. The operations of these electromagnetic valves 29 and 30 are controlled by the ECU 5.

The ECU 5 comprises an input circuit having the functions of shaping the waveforms of input signals from the various sensors, shifting the voltage levels of sensor output signals to a predetermined level, converting analog signals to digital signals, and so forth, a central processing unit (hereinafter referred to "the CPU"), memory means storing programs executed by the CPU and for storing results of calculations therefrom, etc., and an output circuit supplying driving signals to the fuel injection valve 6, the puff loss valve 22, the bypass valve 24, the jet purge control valve 29 and the purge control valve 30. The ECU 5 stores a PTANK-monitoring program described hereinbelow with reference to FIG. 2A to FIG. 2C, and a negative pressure check program, described hereinbelow with reference to FIG. 4A to FIG. 5, in the memory means.

Figures 2, 2A:
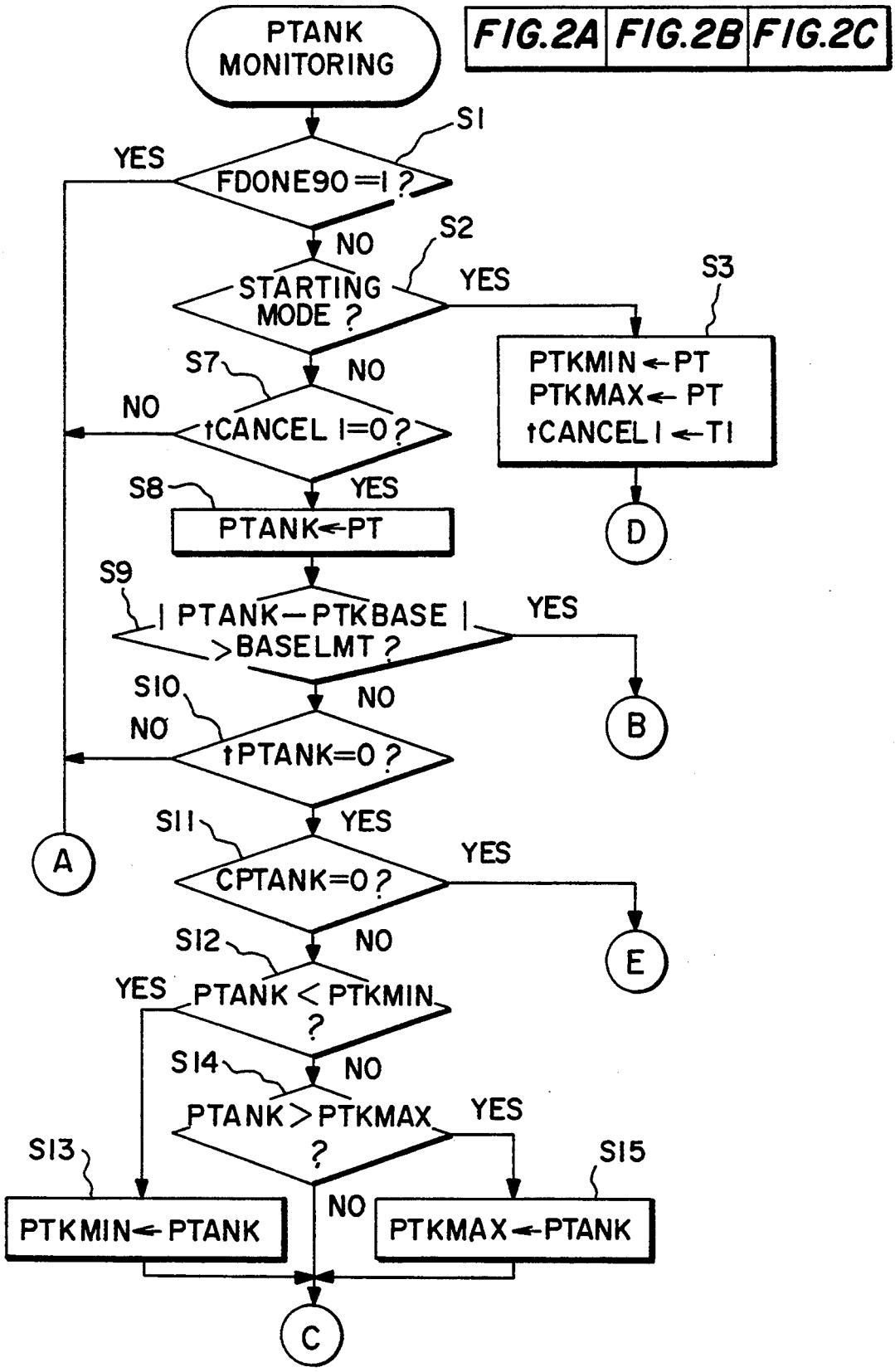
FIG. 2A is a flowchart showing part of a PTANK-monitoring routine carried out by the embodiment system.
Figure 2B:
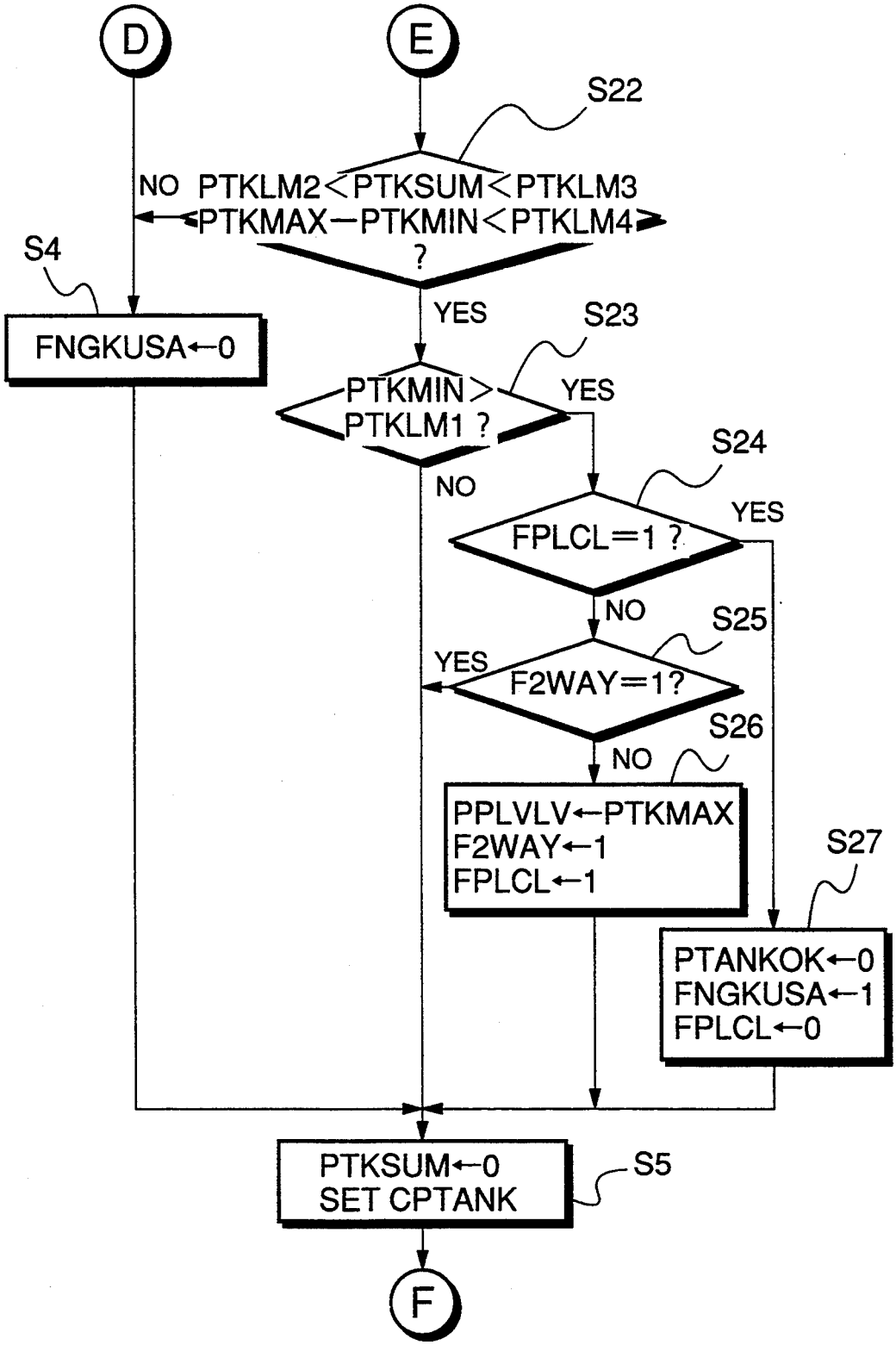
FIG. 2B is a flowchart showing a continuation of the FIG. 2A routine.
Figure 2C:
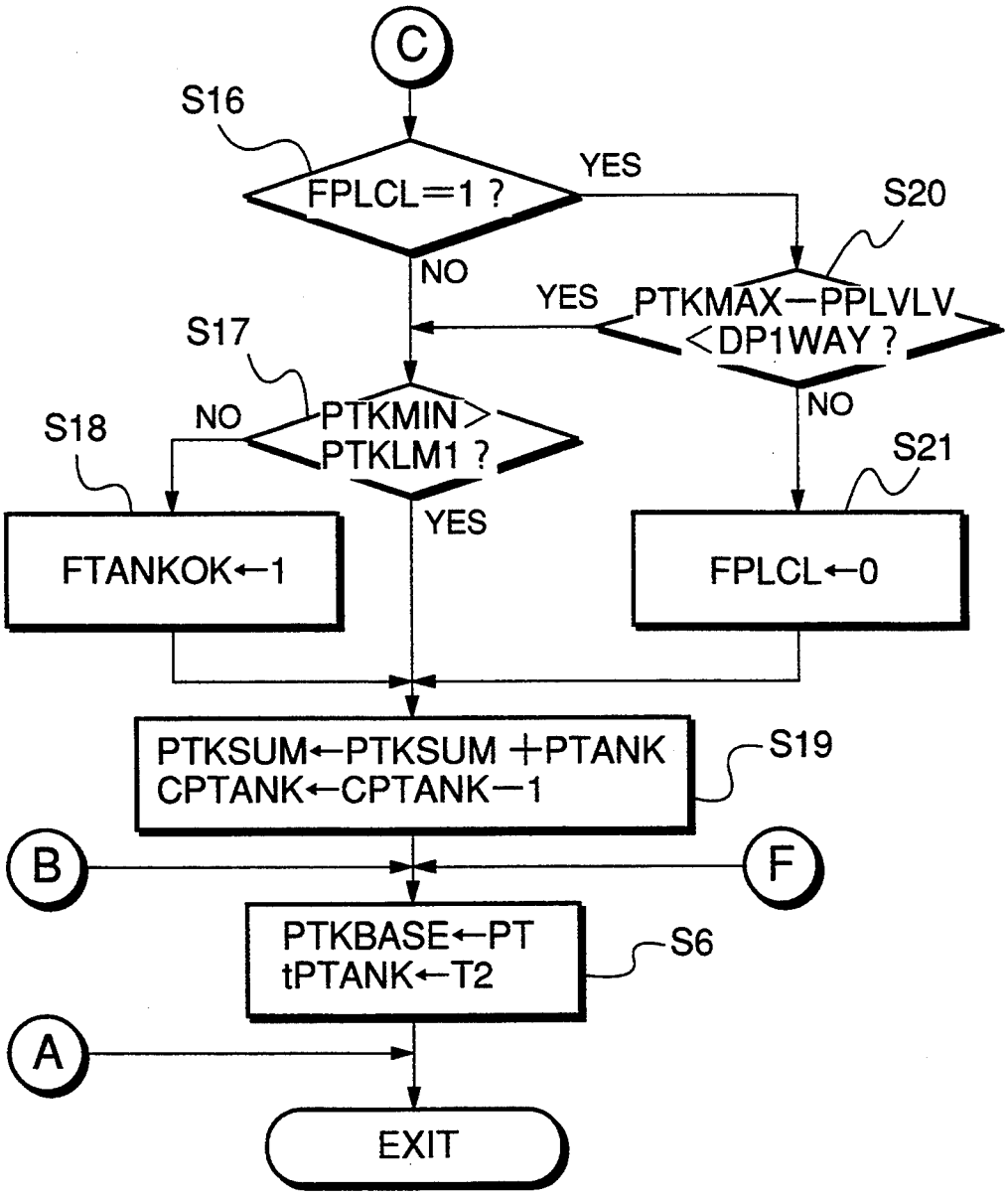
FIG. 2C is a flowchart showing the remaining part of the FIG. 2A and FIG. 2B routine.
Figure 3:
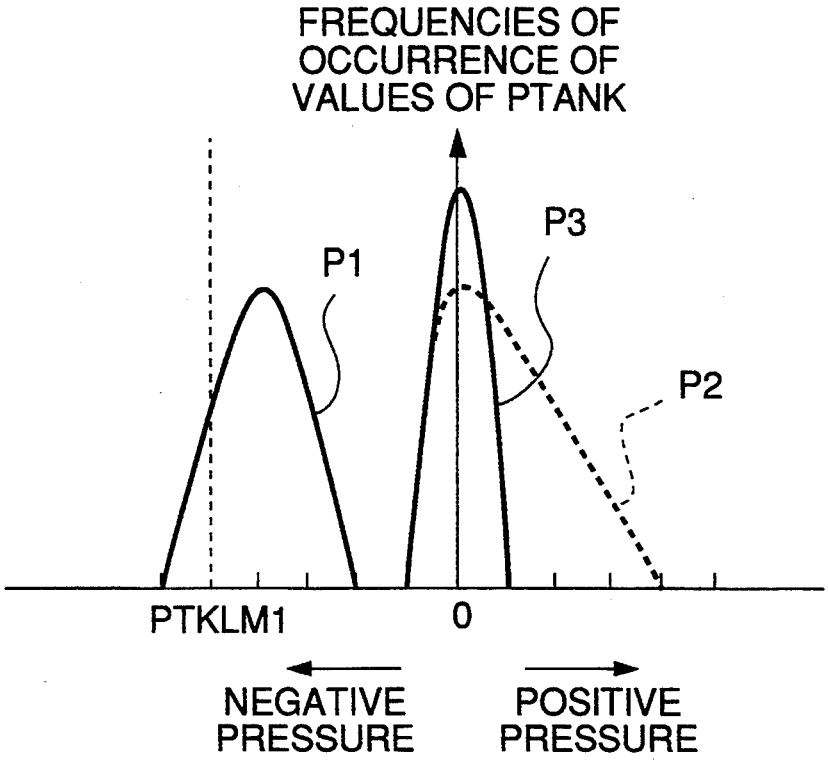
FIG. 3 is a graph showing a frequency of the tank internal pressure value PTANK detected during the PTANK monitoring.

FIG. 2A to FIG. 2C show the PTANK-monitoring program for monitoring the tank internal pressure PT to check for abnormality of the emission control system 31. This program is executed whenever a predetermined time period (e.g. 80 msec) elapses. FIG. 3 shows an example of frequencies of occurrences of values of the tank internal pressure PT detected and read in under conditions, described hereinbelow, during execution of the PTANK-monitoring program.

First, at a step S1, it is determined whether or not a flag FDONE 90, which is set to a value of 1 when a negative pressure check, which will be described hereinafter, has been terminated, is equal to 1. When this step is first carried out, the answer to this question is negative (NO), and it is determined at a step S2 whether or not the engine 1 is in the starting mode. If the answer to this question is affirmative (YES), i.e. if the engine is in the starting mode, the present value of the tank internal pressure PT is set to a minimum value PTKMIN and a maximum value PTKMAX thereof and at the same time a timer tCANCEL1 for pressure cancellation is set to a predetermined time period T1 at a step S3.

Then, a flag FNGKUSA, which is set to a value of 1 when there is a high possibility of existence of a leak in the emission control system 31, is set to a value of 0 at a step S4, and a summed-up value PTKSUM of PTANK values, referred to hereinbelow, is set to a value of 0, while a counter CPTANK for counting the number of executions of the PTANK monitoring (the number of samplings) is set to a predetermine value (e.g. 255), at a step S5. Then, the tank internal pressure PT assumed at this time point is set to a reference value PTKBASE for use in calculating variation in the tank internal pressure PT, and a tPTANK timer determining an interval for sampling the tank internal pressure PT is set to a predetermined time period T2 (e.g. 5 seconds), at a step S6, followed by terminating the program.

If the answer to the question of the step S2 is negative (NO), which means the engine has entered a normal mode, the program proceeds to a step S7, wherein it is determined whether or not the count value of the timer tCANCEL1 is equal to "0", which means that the predetermined time period T1 has elapsed. If the answer to this question is negative (NO), the present routine is immediately terminated, whereas if it is affirmative (YES), the present value of the tank internal pressure PT is read in as a value PTANK at a step S8. At the following step S9, it is determined whether or not the absolute value of a difference between the reference value PTKBASE and the value PTANK is larger than a predetermined threshold value BASELMT. If the answer to this question is affirmative (YES), it is determined that variation of the tank internal pressure PT is too large, and hence the processing at the step S6 is executed again in order to read in only a stabilized value of the tank internal pressure PTANK. That is, the reference value PTKBASE is reset to the present value of the tank internal pressure PT and the tPTANK timer to the predetermined value T2.

Further, if the answer to the question of the step S9 is negative (NO), it is determined that the variation in the tank internal pressure PT is not so large and suitable for execution of the PTANK monitoring, and it is determined at a step S10 whether or not the count value of the tPTANK timer is equal to "0". If the answer to this question is negative (NO), the present routine is immediately terminated, whereas if the answer is affirmative (YES), the program proceeds to a step S11.

Thus, a value of the tank internal pressure PT assumed when the output from the tank internal pressure sensor 11 is not largely changed is read in at intervals of the predetermined time period T2.

At the step S11, it is determined whether or not the count value of the counter CPTANK is equal to "0". When this step is first carried out, the answer to this question is negative (NO), and the program proceeds to a step S12, wherein it is determined whether or not the value PTANK set in the present loop is smaller than the minimum value PTKMIN. If the answer to this question is affirmative (YES), the value PTANK is set to the minimum value PTMIN at a step S13. On the other hand, if the answer to the question of the step S12 is negative (NO), it is determined at a step S14 whether or not the value PTANK set in this loop is larger than the maximum value PTKMAX. If the answer to this question is affirmative (YES), the value PTANK is set to the maximum value PTKMAX at a step S15.

At the following step S16, it is determined whether or not a flag FPLCL, which is set to a value of 1 when the puff loss valve 22 is closed during execution of the PTANK monitoring, is equal to "1". When this step is first carried out, the answer to this question is negative (NO), i.e. the puff loss valve 22 is open (for one-way control), and the program proceeds to a step S17, wherein it is determined whether or not the minimum value PTKMIN is larger than a predetermined value PTKLM1 (e.g. −5 mmHg). If the answer to this question is negative (NO), it is determined that there is no leak in the fuel tank 9 but it is in a normal state, and a flag FTANKOK is set to a value of "1" at a step S18, followed by the program proceeding to a step S19.

The determination that there is no leak in the fuel tank side of the system when the minimum value PTKMIN of the tank internal pressure PT is smaller than a predetermined value PTKLM1 (e.g. −5 mmHg) is based on the experimental finding that if the pressure within the fuel tank side part of the system is controlled by the one-way valve 21 and the two-way valve 23 when there is no leak in the fuel tank side part of the system, evaporative fuel within the fuel tank can be cooled and liquefied to negatively pressurize the fuel tank side part, whereas when there is a leak, the pressure within the fuel tank side part cannot become lower than the atmospheric pressure. In short, it can be determined that there is no leak in the fuel tank side part of the system when the minimum value PTKMIN of the tank internal pressure PT becomes lower than the predetermined value PTKLM1 which is lower than the atmospheric pressure, i.e. negative, as shown by a solid line P1 in FIG. 3.

On the other hand, if the answer to the question of the step S17 is affirmative (YES), the program jumps over to a step S19 by skipping the step S18. At the step S19, the value PTANK set in the present loop is added to the sum of values of same sampled up to the present loop to update the summed-up value PTKSUM, while the count value of the counter CPTANK is decreased by a decremental value of 1. Then, the step S6 is carried out again, followed by terminating the routine.

When the processing described above is repeatedly carried out 255 times, the count value of the counter CPTANK becomes equal to "0", and accordingly the answer to the question of the step S11 becomes affirmative (YES). At this time point, the total number of values of the tank internal pressure PT sampled one by one at intervals of the predetermined time period tPTANK set by the tPTANK timer is 255.

At the following step S22,it is determined whether or not the summed-up value PTKSUM falls between a predetermined negative value PTKLM2 (e.g. −5 mmHg×255) and a predetermined positive value PTKLM3 (e.g. +5 mmHg×255) and at the same time the difference between the maximum value PTKMAX and the minimum value PTKMIN is smaller than a predetermined value PTKLM4 (e.g. 3 mmHg). The former comparison is equivalent to comparison of an average value of the value PTANK with predetermined negative and positive values ( ±5 mmHG). If the answer to this question is negative (NO), it is determined that the tank internal pressure is changing, and the program proceeds to the step S4, wherein the flag FNGKUSA is set to a value of 0, followed by carrying out the step S5 et seq, again.

On the other hand, if the answer to the question of the step S22 is affirmative (YES), it is determined that the tank internal pressure PT is fixed to the atmospheric pressure or its vicinity, and it is determined at a step S23 whether or not the minimum value PTKMIN is higher than the predetermined value PTKLM1. If the answer to this question is negative (NO), it is determined that the fuel tank side part of the system was in a negatively-pressurized state at least once during sampling, and the step S5 et seq. are carried out again. If the answer to the question of the step S23 is affirmative (YES), it is determined that the tank internal pressure PT has not been negative enough even once but fixed to the atmospheric pressure or its vicinity, and the program proceeds to a step S24 et seq.

The fact that the tank internal pressure PT has not been negative enough but fixed to the atmospheric pressure or its vicinity can be ascribed to four cases of the state of the system in which: (1) there is a large leak, (2) there is a small leak and at the same time evaporative fuel is generated at a small rate, (3) there is no leak and at the same time evaporative fuel is generated at a small rate, and (4) evaporative fuel is generated at a large rate and the tank internal pressure PTANK is controlled to the valve-opening pressure (5 mmHg) of the one-way valve 21.

As shown in (4) of the above cases, the tank internal pressure PT can be fixed to the atmospheric pressure or its vicinity when it is controlled to the valve-opening pressure of the one-way valve 21. This is because there is an output variation (zero-point variation) within a range of approximately ±15 mmHg inherent to an individual tank internal pressure sensor 11, and hence if the output from the tank internal pressure sensor 11 is lower than its proper value by 5 mmHg, the tank internal pressure PT can fixedly exhibit the atmospheric pressure (0 mmHg) even when the tank internal pressure PT is actually controlled to the valve-opening pressure (5 mmHg) of the one-way valve 21. Therefore, if the output from the tank internal pressure 11 is within a range of −5 mmHg to +5 mmHg, the tank internal pressure PT should be regarded as substantially equal to the atmospheric pressure.

(1) to (3) of the above cases correspond to a state of the fuel tank in which its internal pressure is actually equal to the atmospheric pressure or its vicinity, and hence there is a large possibility of leakage of evaporative fuel. In the case (4), however, it is presumed that evaporative fuel is generated to create the internal pressure up to the valve-opening pressure of the one-way valve 21, and hence there is a small possibility of leakage. Therefore, in the present embodiment, whether or not the holding of the tank internal pressure PT at the atmospheric pressure or its vicinity without assuming a negative value can be ascribed to the case (4) is determined at the following step S24 et seq, whereby the case (4) is distinguished from the cases (1) to (3).

At the step S24, it is determined whether or not the flag FPLC1 is equal to "1". When this step is first carried out, the puff loss valve 22 is open (during one-way control), and hence the answer to this question is negative (NO), so that the program proceeds to a step S25, wherein it is determined whether or not a flag F2WAY, which is set to a value of 1 when two-way control by the two-way control valve 23 is executed, is equal to 1. When the one-way control is being executed, the flag F2WAY is equal to "0", and the program proceeds to a step S26, wherein a reference pressure value PPLVLV for determining whether or not the holding of the tank internal pressure should be ascribed to operation of the one-way valve 21 is set to the maximum value PTLMAX, the flag F2l WAY is set to "1", and the flag FPLCL is set to "1" to close the puff loss valve 22, setting the system to the two-way control mode.

Thereafter, the step S5 et seq. are carried out again to check variation in the tank internal pressure PT. That is, one value thereof is read in at intervals of the predetermined time period T2 set by the tPTANK timer. On this occasion, the answer to the question of the step S16 becomes affirmative (YES), and accordingly it is determined at a step S20 whether or not a difference between the maximum value PTKMAX and the reference pressure value PPLVLV for determining the fixed state of the one-way valve 21 obtained by subtracting the latter from the former is smaller than a predetermined value DP1WAY. If the answer to this question is affirmative (YES), it is determined that no increase in the tank internal pressure PT occurs during the two-way control, and the program proceeds to a step S17 et seq.

If the answer to the question of the step S20 is negative (NO), it is determined that the tank internal pressure PT has increased during the two-way control, and the program proceeds to a step S21, where the flag FPLCL is set to "0" to set the system to the one-way control mode, followed by the program proceeding to the step S19 et seq. When the number of values of the tank internal pressure PTANK read in becomes equal to 255, the count value of the counter CPTANK becomes equal to "0" and the answer to the question of the step S11 becomes affirmative (YES) again.

Then, if the tank internal pressure PT has increased in the meanwhile, the maximum value PTKMAX changes accordingly, and hence the answer to the question of the step S22 becomes negative (NO), and the flag FNGKUSA is set to "0" at the step S4. That is, under the two-way control in which the puff loss valve is closed, if the tank internal pressure PT is controlled to the valve-opening pressure (5 mmHg) of the one-way valve 21 while evaporative fuel is generated at a large rate without leakage ((4) of the above cases), it is expected that the tank internal pressure PT should rise as time elapses, as shown by the broken line P2 in FIG. 3. Therefore, in the event of the case (4), it is considered that there is a high possibility that the fuel tank 9 is normal, and hence the flag FNGKUSA is set to "0", followed by repeating the step S5 et seq.

On the other hand, if results of check on variation of the tank internal pressure PT show that the tank internal pressure PT remains fixed to the atmospheric pressure or its vicinity, as shown by a solid line P3 in FIG. 3, the answers to the questions of the steps S22 and S23 are affirmative (YES). Accordingly, the system is set to the two-way control mode at the step S26, and hence the answer to the question of the step S24 becomes affirmative (YES), and the program proceeds to a step S27, wherein, determining that the present state of the tank internal pressure PT can be ascribed to one of the cases: (1) there is a large leak, (2) there is a small leak and at the same evaporative fuel is generated at a small rate, and (3) there is no leak and at the same time evaporative fuel is generated at a small rate, the flag PTANKOK is set to "0" and the flag NGKUSA is set to "1" as well as the flag FPLCL is set to "0", to actually make the negative pressure check on the fuel tank side part of the system, described hereinbelow. Thereafter, the steps S5 and S6 are carried out, followed by terminating the program.

Next, the method of the negative pressure check for the emission control system 31 will be described in detail.

Figures 4, 4A:
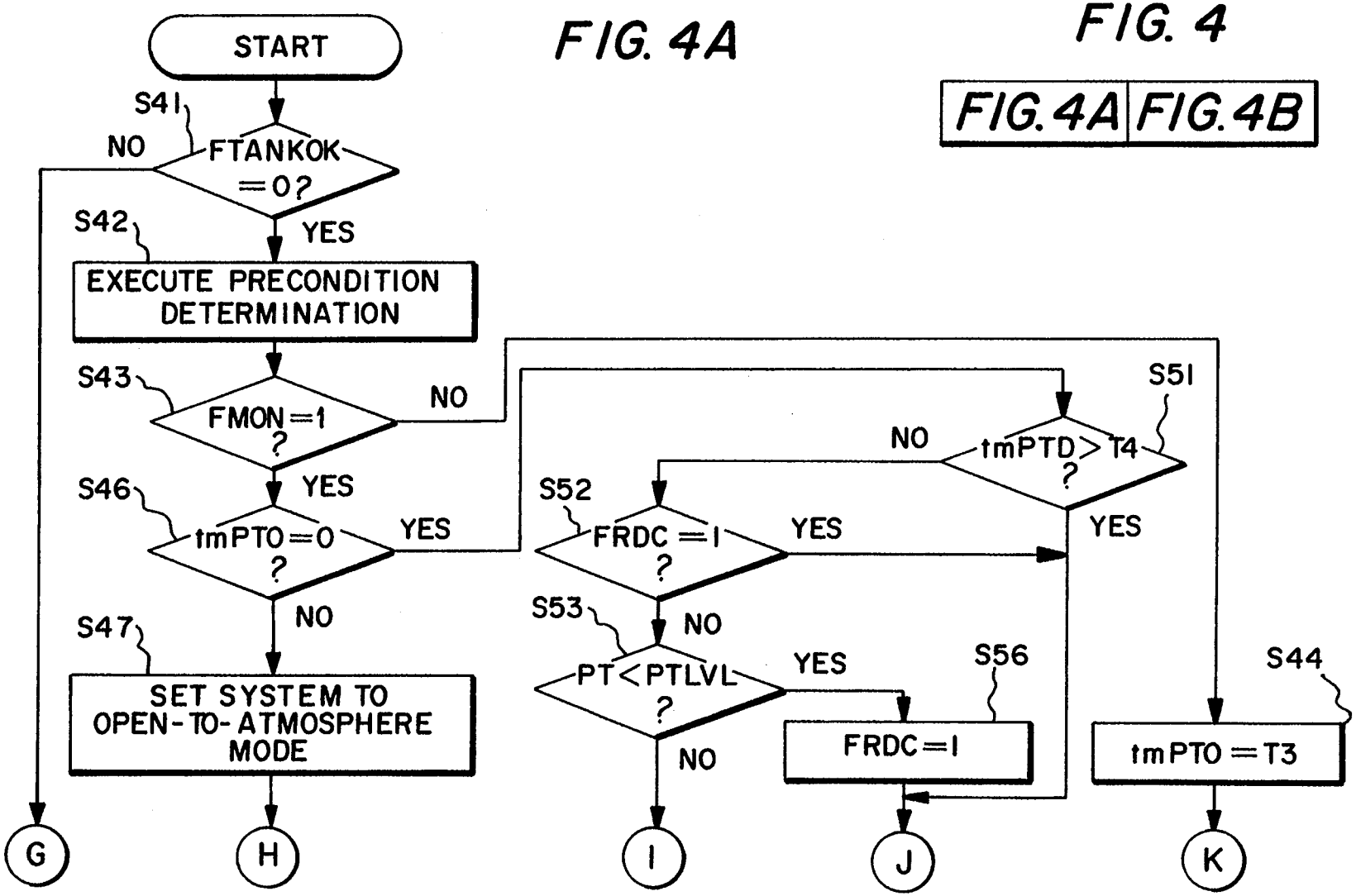
FIG. 4A is a flowchart showing a routine for determining abnormality of the system.
Figure 4B:
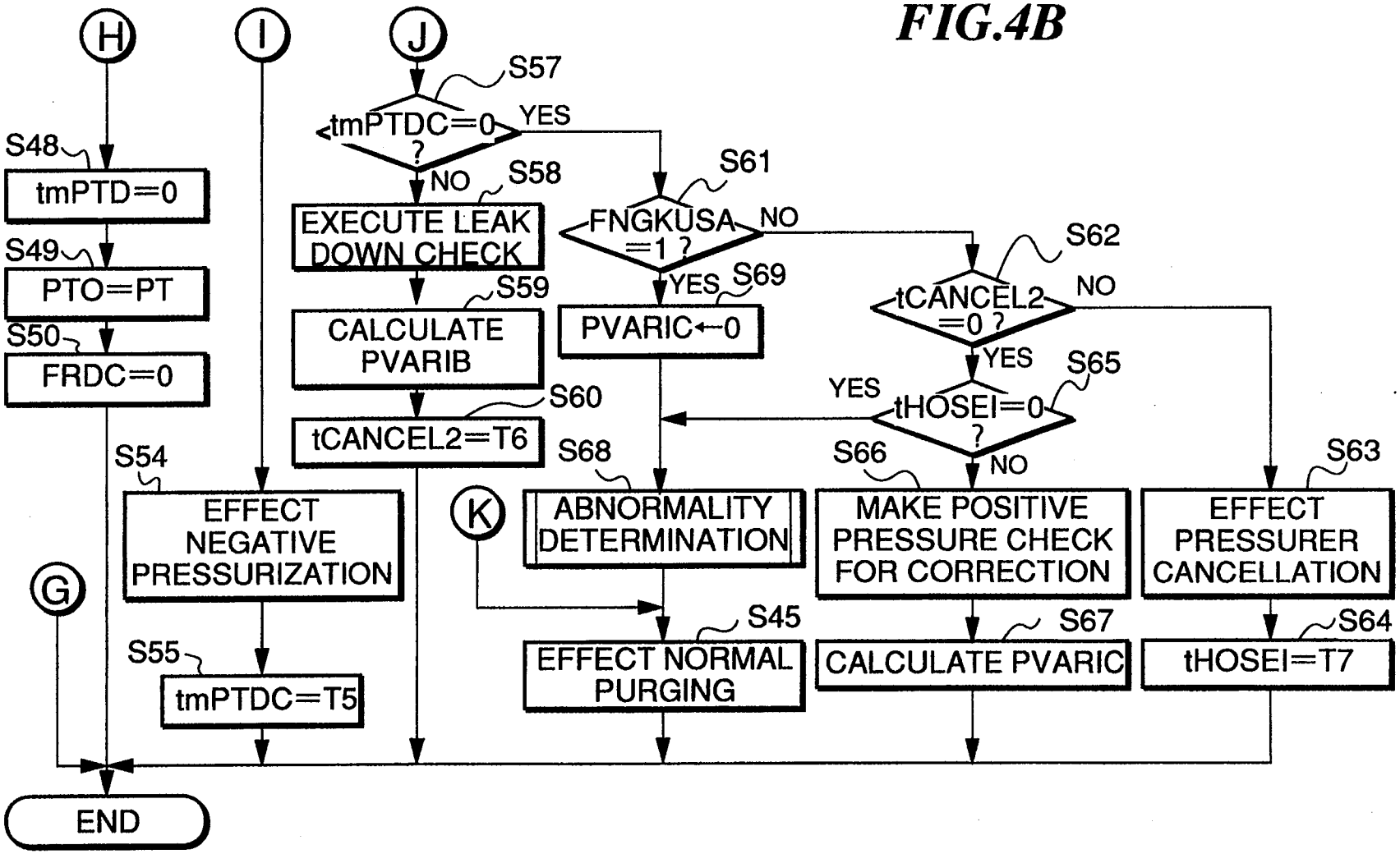
FIG. 4B is a flowchart showing the remaining part of the FIG. 4A routine.

FIG. 4A and FIG. 4B show a program for making the negative pressure check on the fuel tank side part of the system, which is executed by background processing whenever a predetermined time period (e.g. 80 msec) elapses.

First, at a step S41, it is determined whether or not the flag FTANKOK, which is set in the PTANK-monitoring program described above, is equal to "0". If the answer to this question is negative (NO), the present program is immediately terminated, whereas if the answer is affirmative (YES), the program proceeds to a step S42. At the step S42, the precondition determination for permitting the negative pressure check is performed to determine whether the engine has been warmed up and is operating in a stable condition, from the engine coolant temperature TW, the intake air temperature TA, the engine rotational speed NE, etc., setting a flag FMON to "1" when the precondition is satisfied or setting same to "0" when it is not satisfied.

At the following step S43, it is determined whether or not the flag FMON has been set to "1" by the precondition determination at the step S42. When the engine has just been started, the precondition is not satisfied and hence the answer to the question of the step S43 is negative (NO), and the program proceeds to a step S44, wherein a first timer tmPTO is set to a predetermined time period T3. The predetermined time period T3 in this embodiment is set e.g. to 30 seconds which is required to elapse before the tank internal pressure PT is stabilized after the system is made open to the atmosphere to relieve the tank internal pressure to the atmospheric pressure, and the first timer tmPTO is started. Then, the program proceeds to a step S45, where the emission control system 31 is set to the normal purging mode, followed by terminating the program. In other words, the purge control valve 30, the puff loss valve 22, the drain shut valve 26, and the jet purge valve 29 are opened while the bypass valve 24 is closed. In this connection, the open state of the purge control valve 30 means a state in which the purge control valve 30 is opened at a duty control ratio dependent on the operating conditions of the engine 1.

On the other hand, if the precondition is satisfied in a subsequent loop, the flag FMON is set to "1", and it is determined at a step S46 whether or not the count value of the first timer tmPTO becomes equal to 0, i.e. whether or not the predetermined time period T3 has elapsed. When this step is first carried out, the answer to this question is negative (NO), and the program proceeds to a step S47, where the emission control system 31 is set to the open-to-atmosphere mode in which the bypass valve 24 is opened, and the purge control valve 30 is closed, with the puff loss valve 22, the drain shut valve 26 and the jet purge valve 29 being held to the respective open states.

Then, a second timer tmPTD (upcounter) is set to "0" at a step S48. The second timer tmPTD measures a time period required to elapse before negative pressurization of the system is completed, with an initially set value of tmPTD=0. A value PTO of the tank internal pressure PT in the open-to-atmosphere mode is set to the present value of the tank internal pressure PT at a step S49, and a flat FRDC, which is set to "1" when the negative pressurization of the system is completed, is set to "0" at a step S50, followed by terminating the program. That is, the value PTO of the tank internal pressure assumed when the system is open to the atmosphere is updated to the present value, and the flag FRDC is reset, followed by terminating the program.

Then, when the answer to the question of the step S46 is affirmative (YES) after the lapse of the predetermined time period T3 set by the first timer tmPTO, it is determined at a step S51 whether the count value of the second timer tmPTD is larger than a predetermined time period T4. When this step is first carried out, the answer to this question is negative (NO), and hence the program proceeds to a step S52, wherein it is determined whether or not the flag FRDC is equal to "1". When this step is first carried out, the answer to the question is negative (NO), and hence it is determined at a step S53 whether or not the tank internal pressure PT is lower than a predetermined reference value PTLVL. When this step is first carried, the answer to the question is also negative (NO), and hence the negative pressurization is carried out at a step S54. That is, the puff loss valve 22 and the drain shut valve 26 are closed, and the purge control valve 30 is opened, with the jet purge valve 29 and the bypass valve 24 being kept open to negatively pressurize the emission control system 31.

Then, the program proceeds to a step S55, wherein a third timer tmPTDC for the leak down check is set to a predetermined time period T5, followed by terminating the program. The predetermined time period T5 is set e.g. to 5 seconds, which is required to elapse before the leak down check is finished.

If the negative pressurization is successfully completed and the answer to the question of the step S53 becomes affirmative (YES) in the following loops, the flag FRDC is set to "1" at a step S56, and then it is determined at a step S57 whether or not the count value of the third timer tmPTDC is equal to "0", i.e. whether or not the predetermined time period T5 set for the leak down check has elapsed. If the answer to the question of the step S51 is affirmative (YES) as well, i.e. if the negative pressurization has not been successfully completed within the predetermined time period T2, the program proceeds to the step S57. If the flag FRDC remains equal to "0" on this occasion, it means that the system could not be negatively pressurized to the set level within the predetermined time period T4.

When the step S57 is first carried out, the answer to the question of this step is negative (NO), the program proceeds to a step S58, where the emission control system 31 is set to the leak down check mode. That is, the bypass valve 24, the jet purge valve 29 and the purge control valve 30 are closed, with the puff loss valve 22 and the drain shut valve being kept closed, to measure the tank internal pressure PT, storing a measured value of the tank internal pressure PT as a value PEND.

Then, based on the value PEND thus measured, the rate of change PVARIB in the tank internal pressure PT per unit time during the leak down check is calculated according to the following equation:

$$PVARIB=(PEND-PTLVL)/T5$$

Further, at a step S60, a timer tCANCEL2 is set to a predetermined time period T6 required to elapse before the pressure cancellation is completed, followed by terminating the program.

On the other hand, when the answer to the question of the step S57 becomes affirmative (YES), the program proceeds to a step S61, wherein it is determined whether or not the flag FNGKUSA set in the PTANK monitoring described above is equal to "1". If the answer to this question is negative (NO), the program proceeds to a step S62, wherein it is determined whether or not the count value of the timer tCANCEL2 is equal to "0". When this step is first carried out, the answer to this question is negative (NO), the program proceeds to a step S63, wherein the pressure cancellation processing is carried out. That is, the puff loss valve 22 and the purge control valve 30 are kept closed, and the bypass valve 24, the drain shut valve 26 and the jet purge valve 29 are opened to relieve the pressure within the system to the atmospheric pressure, storing a value of the tank internal pressure PT obtained at this time as the value PATM. Then, a timer tHOSEI is set to a predetermined time period T7 required for completing the check for positive pressure for correction at a step S64, followed by terminating the program.

When the answer to the question of the step S62 becomes affirmative (YES), the program proceeds to a step S65, wherein it is determined whether or not the count value of the tHOSEI timer is equal to "0". When this step is first carried out, the answer to this question is negative (NO), and the program proceeds to a step S66, wherein the check for positive pressure for correction is made, followed by terminating the program. During the check for positive pressure for correction, the bypass valve 24 is closed, with the puff loss valve 22 and the purge control valve 30 being kept closed, and the drain shut valve 26 and the jet purge valve 29 being kept open, storing a value of the tank internal pressure PT obtained then as a value PENDB. Then, based on the value PENDB thus obtained, a rate of change PVARIC in the tank internal pressure PT per unit time during the check for positive pressure for correction is calculated at a step S67 according to the following equation:

$$PVARIC=(PENDB-PATM)/T7$$

When the answer to the question of the step S65 becomes affirmative (YES), the program proceeds to a step S68, wherein the abnormality determination processing is carried out on the evaporative emission control system.

Further, when the answer to the question of the step S61 is affirmative (YES), i.e. if the flag FNGKUSA is equal to "1", the pressure cancellation and the check for positive pressure for correction are omitted, and the rate of change PVARIC is set to "0" at a step S69, followed by executing the abnormality determination processing on the system at the step S68. That is, if the flag FNGKUSA is equal to "1", the tank internal pressure PT is fixed to the atmospheric pressure or its vicinity, and hence it is not required to perform the check for positive pressure for correction, so that the pressure cancellation and the check for positive pressure for correction are omitted. After the step S68, the puff loss valve 22 and the purge control valve 30 are opened, with the bypass valve 24 being kept closed and the drain shut valve 26 and the jet purge control valve 29 being kept open, thereby setting the system to the normal purging mode, at a step S45.

Figure 5:
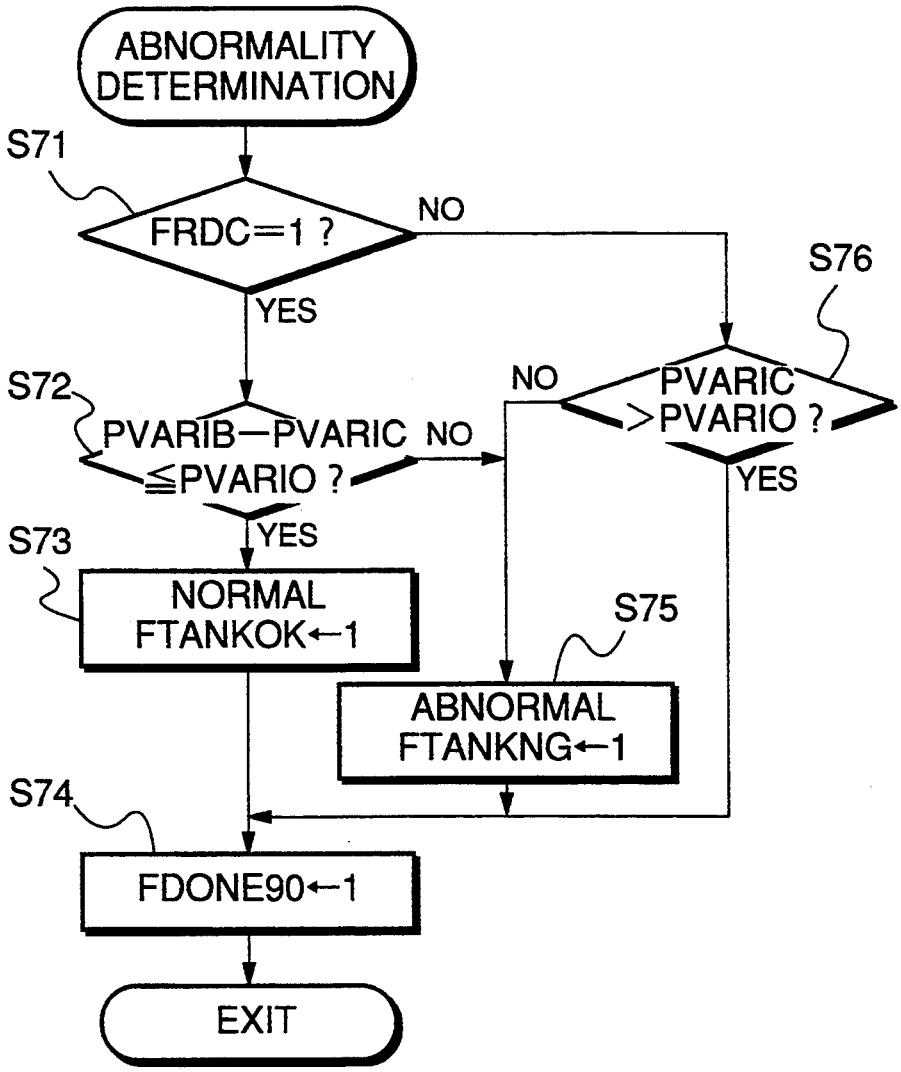
FIG. 5 is a flowchart showing a subroutine for determining abnormality of the evaporative emission control system.

FIG. 5 shows a subroutine for the abnormality determination processing executed on the system at the step S68 in FIG. 4B.

First, at a step S71, it is determined whether or not the flag FRDC which is set to "1" (at the step S56 in FIG. 4A) when the negative pressurization has been completed within the predetermined time period T4 is equal to "1". If the answer to this question is affirmative (YES), the program proceeds to a step S72, wherein it is determined whether or not the difference between PVARIB and PVARIC obtained by subtracting the latter from the former is not larger than a predetermine value PVARIO. If the answer to this question is affirmative (YES), it is determined that the emission control system is normal, i.e. there is no leak and the flag FTANKOK is set to "1" at a step S73. Then, the flag FDONE90 is set to "1" at a step S74 to indicate that the negative pressure check processing has been completed, followed by terminating the program. If the answer to the question of the step S72 is negative (NO), it is determined that there is a leak in the fuel tank side part of the system, and hence the flag FTANKNG is set to "1" at a step S75, and then the flag FDONE 90 is set to "1" at the step S74, followed by terminating the program.

On the other hand, if the answer to the question of the step S71 is negative (NO), i.e. if the flag FRDC is "0", it is determined at a step S76 whether or not the rate of change PVARIC is larger than the predetermined value PVARIO. If the answer to this question is negative (NO), the program process to the step S75, whereas if the answer is affirmative (YES), the program proceeds to the step S74.

The present invention should not be considered to be limited to the embodiment described above by way of an example, but the scope thereof should be considered to cover variations and modifications made thereto. For example, although in the above embodiment, it is determined that the emission control system 31 is normal without suffering from a leak, when the minimum value PTKMIN of the tank internal pressure PT is lower than the predetermined value PTKLM1, this is not limitative, but there may be employed a technique in which it is determined that the emission control system 31 is normal when the value PTANK of the tank internal pressure PT has become lower than a predetermined value (e.g. −5 mmHg) a plurality of times, or, alternatively, one in which this determination is made based on an average value of the value PTANK of the tank internal pressure PT, to enhance accuracy of detection of abnormality of the system. Further, in performing the negative pressure check, so long as the system includes means for negatively pressuring the system 31 by utilizing negative pressure created within the intake pipe of the engine, similar effects can be expected by carrying out the check according to the method described above.

As described heretofore, according to the evaporative emission control system of the present invention, it is determined that the system is normal when the pressure within the fuel tank side of the evaporative emission control system is detected to be below a predetermined reference value below atmospheric pressure. Therefore, the normally-functioning state of the system can be easily and conveniently determined.

Further, the negative pressure check for abnormality determination is carried out, only when the system is not determined to be normal by the above (PTANK monitoring) processing. Therefore, it is possible to reduce the frequency of the negative pressure check to the minimum, which takes a long time period to complete, whereby it is made possible to prevent degradation of exhaust emission characteristics of the engine caused by the negative pressure check.

What is claimed is:

1. In an evaporative emission control system for an internal combustion engine, including a fuel tank, a canister for adsorbing evaporative fuel generated from the fuel tank, a passage communicating between said fuel tank and said canister, valve means for opening said passage when pressure within part of said evaporative emission control system upstream of said valve means exceeds a predetermined value and closing said passage when said pressure within said part of said evaporative emission control system is below said predetermined value, and pressure-detecting means for detecting said pressure within said part of said evaporative emission control system, the improvement comprising:

diagnosis means for determining that said evaporative emission control system is normal when a value of said pressure within said part of said evaporative emission control system detected by said pressure-detecting means is lower than a predetermined reference value below atmospheric pressure.

2. An evaporative emission control system according to claim 1, wherein said diagnosis means causes said pressure-detecting means to detect said pressure within said part of said evaporative emission control system a plurality of times, and determines that said evaporative emission control system is normal when at least the minimum value of values of said pressure detected by said pressure-detecting means is lower than said predetermined reference value.

3. An evaporative emission control system according to claim 2, wherein said diagnosis means determines that said evaporative emission control system is abnormal, when the minimum value of said values of said pressure within said part of said evaporative emission control system detected by said pressure-detecting means is higher than said predetermined reference value, and at the same time an average value of said values of said pressure within said part of said evaporative emission control system detected by said pressure-detecting means is equal to the atmospheric pressure or a value in the vicinity thereof.

4. An evaporative emission control system according to claim 1, including closing means for forcibly closing said passage, wherein said diagnosis means causes said closing means to close said passage when it is not determined that said evaporative emission control system is normal, and determines that said evaporative emission control system is abnormal when a rise in said pressure occurring thereafter within said part of said evaporative emission control system is below a predetermined value.

5. An evaporative emission control system according to claim 2, including closing means for forcibly closing said passage, wherein said diagnosis means causes said closing means to close said passage when it is not determined that said evaporative emission control system is normal, and determines that said evaporative emission control system is abnormal when a rise in said pressure occurring thereafter within said part of said evaporative emission control system is below a predetermined value.

6. An evaporative emission control system according to claim 3, including closing means for forcibly closing said passage, wherein said diagnosis means causes said closing means to close said passage when it is not determined that said evaporative emission control system is normal, and determines that said evaporative emission control system is abnormal when a rise in said pressure occurring thereafter within said part of said evaporative emission control system is below a predetermined value.

7. An evaporative emission control system according to claim 4, wherein said closing means is second valve means arranged in said passage.

8. An evaporative emission control system according to claim 5, wherein said closing means is second valve means arranged in said passage.

9. An evaporative emission control system according to claim 6, wherein said closing means is second valve means arranged in said passage.

10. An evaporative emission control system according to claim 1, wherein said engine includes an intake passage, and wherein said evaporative emission control system includes an air passage communicating between said canister and the atmosphere, pressure-relieving valve for opening and closing said air passage, a purging passage communicating between said canister and said intake passage, a purge control valve arranged in said purging passage for opening and closing said purging passage, and negative pressure diagnosis means for determining abnormality of said evaporative emission control system, based on values of said pressure detected when said evaporative emission control system is set to a negatively-pressurized state by closing said pressure-relieving valve and opening said purge control valve, and wherein said negative pressure diagnosis means is operated when said diagnosis means has not determined that said evaporative emission control system is normal.

* * * * *